US010575559B2

(12) United States Patent
Li et al.

(10) Patent No.: US 10,575,559 B2
(45) Date of Patent: Mar. 3, 2020

(54) ATOMIZER AND ELECTRONIC CIGARETTE HAVING SAME

(71) Applicant: Shenzhen First Union Technology Co., Ltd., Shenzhen, Guangdong Province (CN)

(72) Inventors: Yonghai Li, Shenzhen (CN); Zhongli Xu, Shenzhen (CN); Yonglu Guo, Shenzhen (CN); Youli Shen, Shenzhen (CN)

(73) Assignee: SHENZHEN FIRST UNION TECHNOLOGY CO., LTD., Shenzhen, Guangdong Province (CN)

( * ) Notice: Subject to any disclaimer, the term of this patent is extended or adjusted under 35 U.S.C. 154(b) by 798 days.

(21) Appl. No.: 15/097,284

(22) Filed: Apr. 12, 2016

(65) Prior Publication Data

US 2016/0219939 A1 Aug. 4, 2016

(30) Foreign Application Priority Data

Jun. 30, 2015 (CN) ..... 2015 2 0457020 U

(51) Int. Cl.
*A24F 47/00* (2006.01)
*H05B 3/42* (2006.01)

(52) U.S. Cl.
CPC ..... *A24F 47/008* (2013.01); *H05B 3/42* (2013.01); *H05B 2203/021* (2013.01); *H05B 2203/022* (2013.01)

(58) Field of Classification Search
CPC ..... A24F 47/008; A24F 47/002; H05B 2203/021; H05B 2203/022; H05B 3/42;
(Continued)

(56) References Cited

U.S. PATENT DOCUMENTS

2014/0060528 A1* 3/2014 Liu ..... A24F 47/002 128/202.21
2014/0130817 A1* 5/2014 Li ..... A24F 47/008 131/329

(Continued)

FOREIGN PATENT DOCUMENTS

WO WO 2016149932 A1 * 9/2016 ..... A24F 47/00

OTHER PUBLICATIONS

Chinese to English machine translation of WO 2016149932.*

*Primary Examiner* — Michael G Hoang
(74) *Attorney, Agent, or Firm* — Cheng-Ju Chiang

(57) ABSTRACT

An exemplary atomizer includes a liquid supply, an atomizing head, and an air passage. The liquid supply has a liquid chamber. The atomizing head includes a liquid absorbing element and a heating element. The liquid supply includes a sealing element at an end connected with the atomizing head. The sealing element is configured for sealing the tobacco liquid in the liquid chamber. The sealing element defines a through hole. The liquid supply further includes a magnet configured for sealing the through hole. The magnet abuts against the sealing element via a magnetic force. The atomizing head further includes an electromagnet. The electromagnet is configured for lifting the magnet when powered on, so that the tobacco liquid can flow out from the through hole. The present disclosure also relates to an electronic cigarette.

16 Claims, 4 Drawing Sheets

(58) Field of Classification Search
CPC ..... H05B 3/40; A61M 11/04; A61M 11/041; A61M 11/042; A61M 11/044; A61M 11/00; A61M 15/06; B65D 83/14; B05B 1/00
USPC ..... 392/386–387, 394–398, 404–406
See application file for complete search history.

(56) References Cited

U.S. PATENT DOCUMENTS

2015/0335073 A1* 11/2015 Li ..... A24F 47/008 131/329
2016/0113326 A1* 4/2016 Li ..... A24F 47/008 131/329
2018/0098575 A1* 4/2018 Liu ..... H05B 3/04

* cited by examiner

ATOMIZER AND ELECTRONIC CIGARETTE HAVING SAME

TECHNICAL FIELD

The present invention relates to electronic cigarettes, and particularly to an atomizer and an electronic cigarette using same.

BACKGROUND ART

A typical atomizer includes an atomizing head and a liquid supply. The liquid supply is configured for storing tobacco liquid. The atomizing head is adapted for generating aerosol from the tobacco liquid. In a non-use state, the tobacco liquid may leak during transportation and storage.

What are needed, therefore, are an atomizer and an electronic cigarette using same, which can overcome the above shortcomings.

SUMMARY

An exemplary atomizer includes a liquid supply, an atomizing head, and an air passage. The liquid supply has a liquid chamber. The atomizing head includes a liquid absorbing element and a heating element. The liquid supply includes a sealing element at an end connected with the atomizing head. The sealing element is configured for sealing the tobacco liquid in the liquid chamber. The sealing element defines a through hole. The liquid supply further includes a magnet configured for sealing the through hole. The magnet abuts against the sealing element via a magnetic force. The atomizing head further includes an electromagnet. The electromagnet is configured for lifting the magnet when powered on, so that the tobacco liquid can flow out from the through hole.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
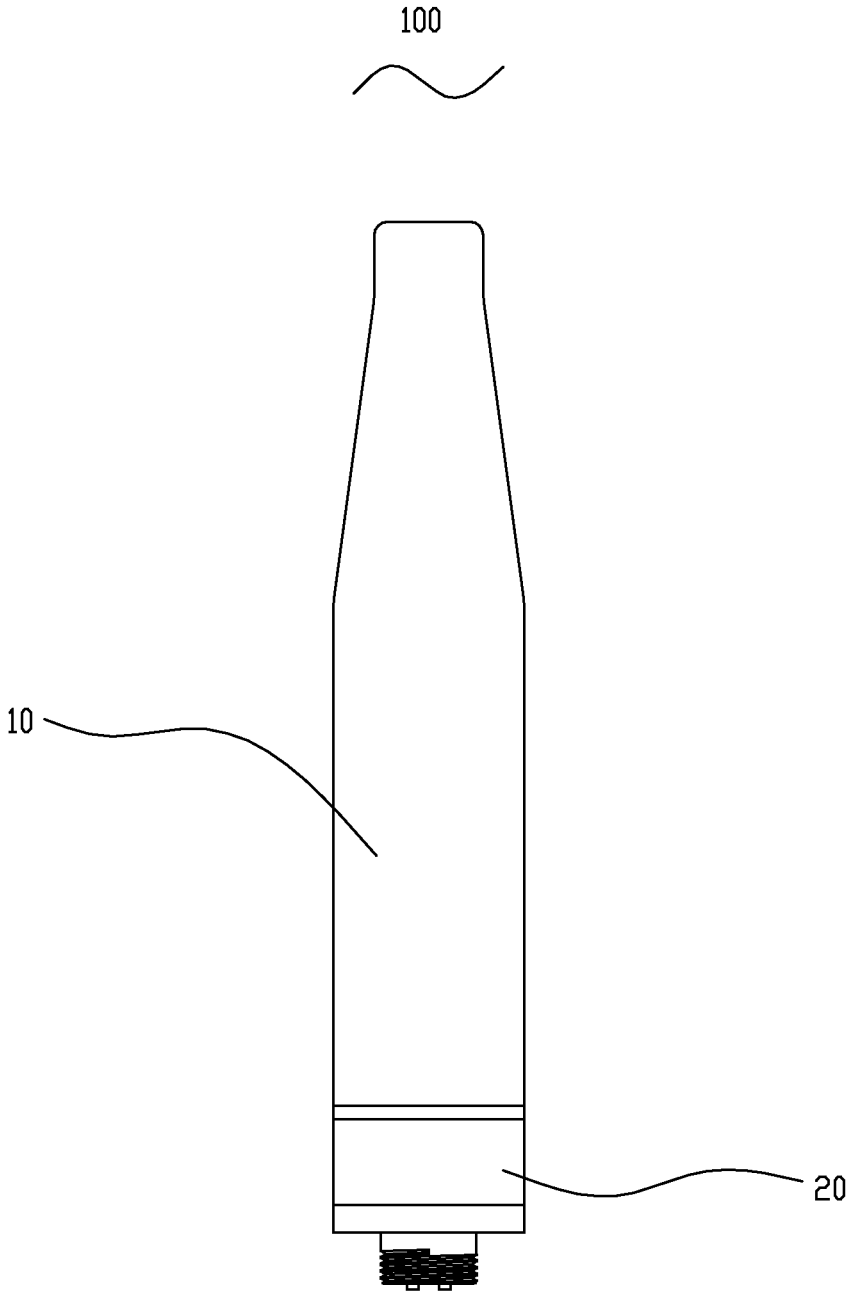
FIG. 1 is a side view of an atomizer according to a first embodiment, including a liquid supply and an atomizing head.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Several definitions that apply throughout this disclosure will now be presented.

The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

Figure 2:
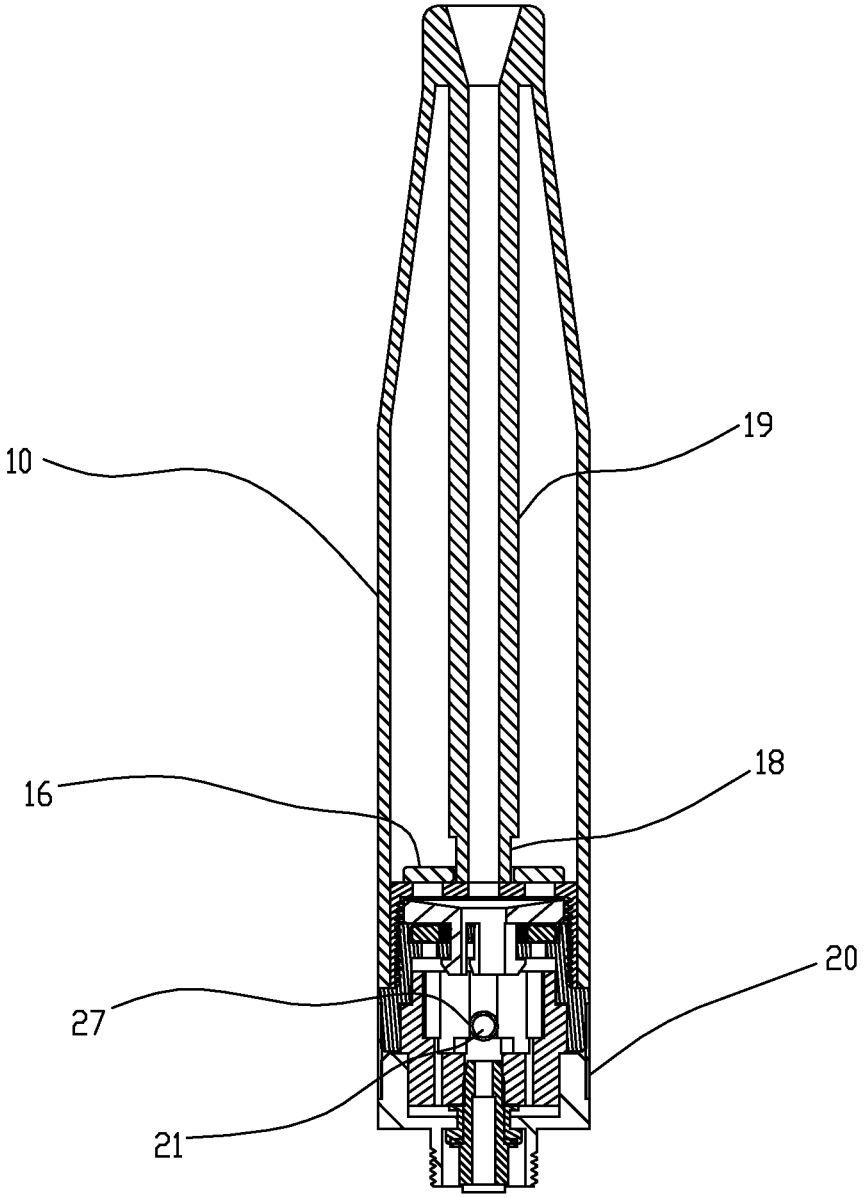
FIG. 2 is a cross-sectional view of the atomizer of FIG. 1.
Figure 3:
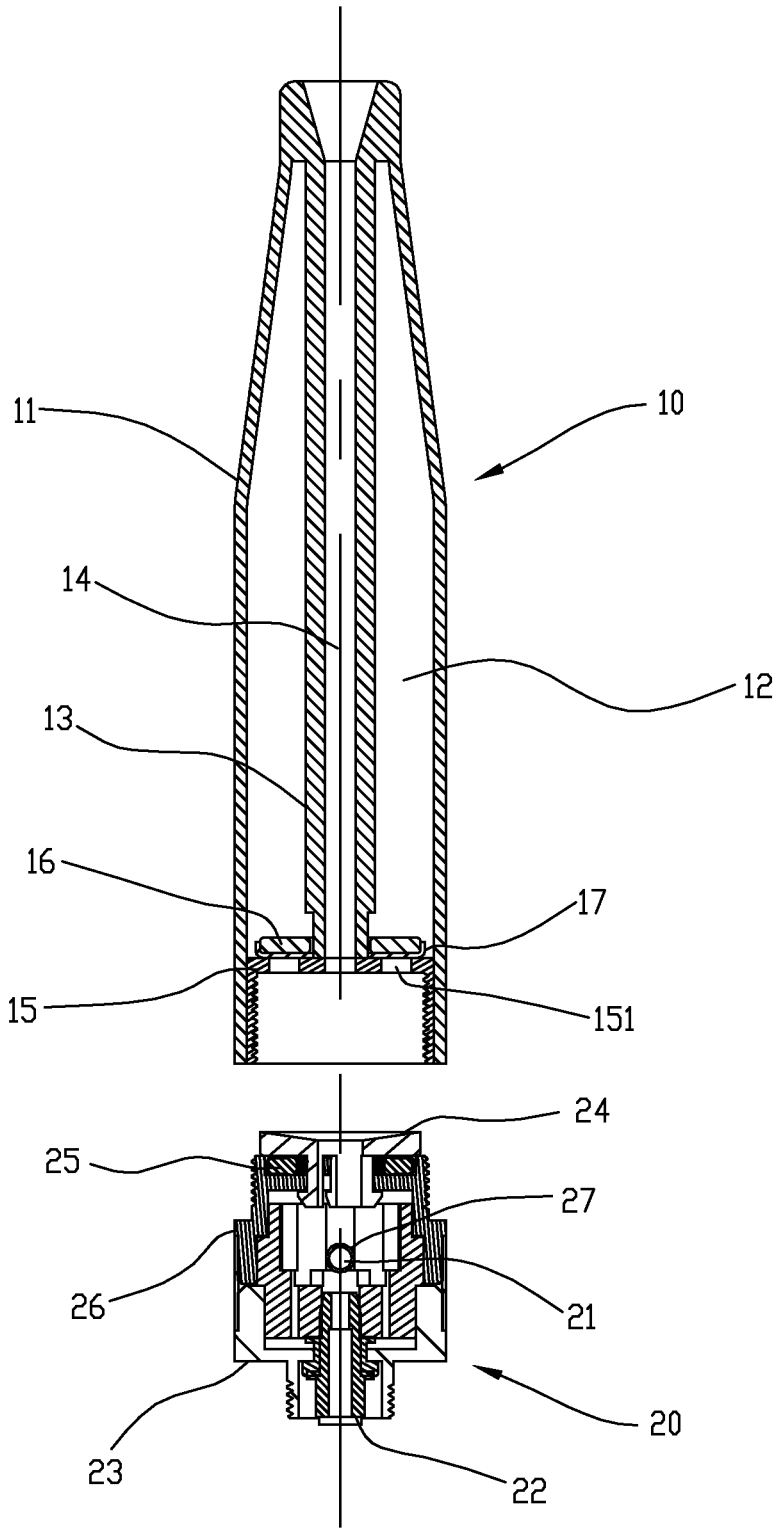
FIG. 3 is a cross-sectional view of the atomizer of FIG. 1, when the liquid supply and the atomizing head are disassembled.

Referring to FIGS. 1-3, an atomizer 100 is shown. The atomizer 100 is configured for coupling with the power supply 200. The atomizer 100 includes a liquid supply 10, an atomizing head 20 engaged with the liquid supply 10, and an air passage 14. The liquid supply 10 is configured (i.e., structured and arranged) for storing tobacco liquid. The atomizing head 20 includes a liquid absorbing element 21 and a heating element 27. The heating element 27 is in contact with the liquid absorbing element 21. The liquid absorbing element 21 is configured for absorbing the tobacco liquid. The heating element 27 is adapted for heating the tobacco liquid absorbed in the liquid absorbing element 21 to form aerosol. The liquid supply 10 defines a liquid chamber 12. A sealing element 15 is arranged at an end of the liquid supply 10 adjacent to the atomizing head 20. The sealing element 15 defines a through hole 151. The sealing element 15 is made of soft magnetic material, for example, nickel. A magnet 16 is provided in the liquid chamber 12, and configured for sealing the through hole 151. The magnet 16 is coupled with the sealing element 15 via a magnetic force. The atomizing head 20 includes an electromagnet 25. The electromagnet 25 is configured for lifting the magnet 16 when powered on, so that the tobacco liquid can flow out via the through hole 151.

Since the magnet 16 is coupled with the sealing element 15, the magnet 16 prevents the liquid absorbing element 21 from absorbing too much tobacco liquid. Accordingly, liquid leakage is greatly reduced or eliminated when the atomizer 100 is not powered on.

Referring to FIG. 3, the atomizing head 20 includes a fixing holder 26, and a liquid conducting element 24. The fixing holder 26 is configured for accommodating the electromagnet 25. The liquid conducting element 24 is configured for collecting the tobacco liquid flowed out from the through hole 151 and conveying the tobacco liquid to the liquid absorbing element 21. The liquid conducting element 24 is arranged on the fixing holder 26. The liquid conducting element 24 is funnel-shaped, and an end surface of the liquid conducting element 24 abuts against the electromagnet 25.

To seal the through hole 151 better, a flexible cushion 17 is sandwiched between the magnet 16 and the sealing element 15.

Figure 4:
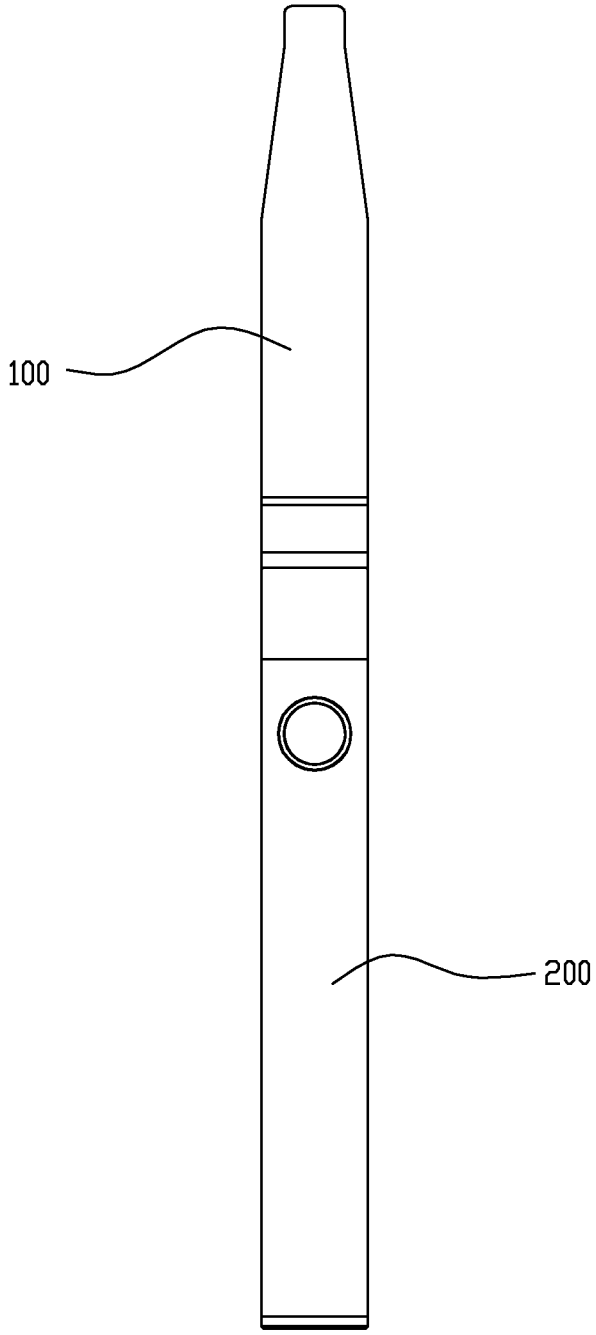
FIG. 4 is a side view of an electronic cigarette according to a second embodiment.

The atomizing head 20 further includes a first electrode 23 and a second electrode 22. The first and the second electrodes 22, 23 are configured for connecting with a power supply 200 (as seen in FIG. 4). Two opposite ends of the heating element 27 are connected to the first and the second electrodes 22, 23, respectively. The electromagnet 25 is also electrically connected with the first and the second electrodes 22, 23.

The liquid chamber 12 includes a restriction groove 18 configured for restricting a stroke of the magnet 16. In detail, the liquid supply 10 includes an air pipe 19, and the air pipe 19 defines part of the air passage 14 in the liquid supply 10. The air pipe 19 defines the restriction groove 18 in an exterior wall. The magnet 16 nests the air pipe 19, and is capable of moving up and down along the air pipe 19 in the restriction groove 18.

Referring to FIG. 4, an electronic cigarette includes the atomizer 100 and a power supply 200. The power supply 200 is detachably connected with the atomizer. The power supply 200 is configured for feeding the atomizer 100 power.

It is understood that the above-described embodiments are intended to illustrate rather than limit the disclosure. Variations may be made to the embodiments and methods without departing from the spirit of the disclosure. Accordingly, it is appropriate that the appended claims be construed broadly and in a manner consistent with the scope of the disclosure.

What is claimed is:

1. An atomizer, comprising:

a liquid supply configured for storing tobacco liquid, the liquid supply having a liquid chamber;

an atomizing head connected with the liquid supply, the atomizing head including a liquid absorbing element and a heating element, the liquid absorbing element being configured for absorbing the tobacco liquid, the heating element being configured for heating the tobacco liquid to form aerosol; and an air passage;

wherein the liquid supply comprises a sealing element at an end connected with the atomizing head, the sealing element is configured for sealing the tobacco liquid in the liquid chamber, the sealing element defines a through hole;

the liquid supply further comprises a magnet configured for sealing the through hole, the magnet abuts against the sealing element via a magnetic force; and the atomizing head further comprises an electromagnet, the electromagnet is configured for lifting the magnet by repelling the magnet away from the sealing element and the electromagnet when powered on, so that the tobacco liquid can flow out from the through hole.

2. The atomizer according to claim 1, further comprising a flexible cushion sandwiched between the magnet and the sealing element.

3. The atomizer according to claim 1, wherein the liquid chamber comprises a restriction groove configured for restricting a stroke of the magnet.

4. The atomizer according to claim 3, wherein the liquid supply comprises an air pipe, the air pipe defines part of the air passage, the restriction groove is defined in an exterior wall of the air pipe; the magnet nests the air pipe, and is received in the restriction groove.

5. The atomizer according to claim 1, wherein the sealing element is made of soft magnetic material.

6. The atomizer according to claim 1, further comprising a holder for receiving the electromagnet, and a liquid conducting element, wherein the liquid conducting element is configured for collecting the tobacco liquid flowed out from the through hole and conveying the tobacco liquid to the liquid absorbing element, the liquid conducting element is arranged on the holder.

7. The atomizer according to claim 6, wherein the liquid conducting element is funnel-shaped, and an end surface of the liquid conducting element abuts against the electromagnet.

8. An electronic cigarette, comprising:

an atomizer according to claim 1; and a power supply configured for feeding the atomizer power.

9. The electronic cigarette according to claim 8, further comprising a flexible cushion sandwiched between the magnet and the sealing element.

10. The electronic cigarette according to claim 8, wherein the liquid chamber comprises a restriction groove configured for restricting a stroke of the magnet.

11. The electronic cigarette according to claim 10, wherein the liquid supply comprises an air pipe, the air pipe defines part of the air passage, the restriction groove is defined in an exterior wall of the air pipe; the magnet nests the air pipe, and is received in the restriction groove.

12. The electronic cigarette according to claim 8, wherein the sealing element is made of soft magnetic material.

13. The electronic cigarette according to claim 8, further comprising a holder for receiving the electromagnet, and a liquid conducting element, wherein the liquid conducting element is configured for collecting the tobacco liquid flowed out from the through hole and conveying the tobacco liquid to the liquid absorbing element, the liquid conducting element is arranged on the holder.

14. The electronic cigarette according to claim 13, wherein the liquid conducting element is funnel-shaped, and an end surface of the liquid conducting element abuts against the electromagnet.

15. An atomizer, comprising:

a liquid supply configured for storing tobacco liquid, the liquid supply having a liquid chamber;

an atomizing head connected with the liquid supply, the atomizing head including a liquid absorbing element and a heating element, the liquid absorbing element being configured for absorbing the tobacco liquid, the heating element being configured for heating the tobacco liquid to form aerosol; and an air passage;

wherein the liquid supply comprises a sealing element at an end connected with the atomizing head, the sealing element is configured for sealing the tobacco liquid in the liquid chamber, the sealing element defines a through hole;

the liquid supply further comprises a magnet configured for sealing the through hole, the magnet abuts against the sealing element via a magnetic force;

the atomizing head further comprises an electromagnet, the electromagnet is configured for lifting the magnet when powered on, so that the tobacco liquid can flow out from the through hole; and the liquid chamber comprises a restriction groove configured for restricting a stroke of the magnet.

16. An atomizer, comprising:

a liquid supply configured for storing tobacco liquid, the liquid supply having a liquid chamber;

an atomizing head connected with the liquid supply, the atomizing head including a liquid absorbing element and a heating element, the liquid absorbing element being configured for absorbing the tobacco liquid, the heating element being configured for heating the tobacco liquid to form aerosol; and an air passage;

wherein the liquid supply comprises a sealing element at an end connected with the atomizing head, the sealing element is configured for sealing the tobacco liquid in the liquid chamber, the sealing element defines a through hole;

the liquid supply further comprises a magnet configured for sealing the through hole, the magnet abuts against the sealing element via a magnetic force;

the atomizing head further comprises an electromagnet, the electromagnet is configured for lifting the magnet when powered on, so that the tobacco liquid can flow out from the through hole; and the atomizer further comprises a flexible cushion sandwiched between the magnet and the sealing element.

* * * * *